US005427544A

United States Patent [19]

Okabe

[11] Patent Number: 5,427,544

[45] Date of Patent: Jun. 27, 1995

[54] PRESS-CONNECTING TERMINAL AND CONNECTOR USING SAME

[75] Inventor: Toshiaki Okabe, Shizuoka, Japan

[73] Assignee: Yazaki Corporation, Tokyo, Japan

[21] Appl. No.: 126,561

[22] Filed: Sep. 27, 1993

[30] Foreign Application Priority Data

Sep. 25, 1992 [JP] Japan ..... 4-279258

[51] Int. Cl.[6] ..... H01R 4/24

[52] U.S. Cl. ..... 439/397; 439/877; 439/395

[58] Field of Search ..... 439/395, 407, 877, 454–456

[56] References Cited

U.S. PATENT DOCUMENTS

| | | | |
|---|---|---|---|
| 2,536,862 | 1/1951 | White | 439/867 |
| 2,983,898 | 5/1961 | Kalmar et al. | 439/877 |
| 3,621,117 | 11/1971 | Antas | 439/877 |
| 3,637,284 | 1/1972 | Rlyler | 439/865 |
| 3,699,328 | 10/1972 | Murray | 439/877 |
| 4,734,055 | 3/1988 | Misu | 439/456 |
| 4,875,875 | 10/1989 | Archer et al. | 439/456 |

*Primary Examiner*—David L. Pirlot

*Attorney, Agent, or Firm*—Sughrue, Mion, Zinn, Macpeak & Seas

[57] ABSTRACT

A press-connecting terminal is formed from an electrically-conductive metal sheet, and includes a wire connection portion at one end portion thereof, and an electrical connection portion at the other end portion thereof for connection to a mating terminal. The wire connection portion includes a press-connecting blade defining a slot into which a covered wire is adapted to be press-fitted, and an insulation barrel for fixing the covered wire in the slot. An opening for receiving part of the covered wire is formed in that region of a bottom plate portion of the wire connection portion where the covered wire is pressed by the insulation barrel. With this construction, the ability of retaining the wire is enhanced, and the material cost for the metal sheet can be reduced. There is also disclosed a connector to which this press-connecting terminal is attached.

8 Claims, 4 Drawing Sheets

PRESS-CONNECTING TERMINAL AND CONNECTOR USING SAME

BACKGROUND OF THE INVENTION

This invention relates to a press-connecting terminal having a press-connecting blade into which an electric wire covered with an insulation material, such as a synthetic resin, is press-fitted to make an electrical connection, and also to a connector having such a press-connecting terminal.

There are known various kinds of connectors for use with a wire harness and in other fields. Also, there are various kinds of connection terminals used with such connectors. Usually, such a connection terminal is formed from an electrically-conductive metal sheet by stamping and shaping. For easily connecting such a terminal to a covered wire without removing a cover of the wire, a press-connecting terminal has been extensively used.

As shown in FIG. 7, a press-connecting terminal 70 includes a wire connection portion 70*a*, and an electrical connection portion 70*b* for connecting to a mating terminal. The wire connection portion 70*a* has a press-connecting blade 72 defining a slot 71 into which a covered wire 73 is adapted to be press-fitted, an insulation barrel 78 for fixing the covered wire 73 in the slot 71. The press-connecting blade 72 and the insulation barrel 78 extend upwardly from a bottom portion 76 (see Japanese Utility Model Unexamined Publication No. 4-15160).

When the wire 73 is press-fitted into the press-fitting blade 72 defining the upwardly-opening slot 71 generally u-shaped, the press-fitting blade 72 cuts the covering of the wire, and is urged into contact with a conductor of the wire 73, thereby making an electrical connection. Structurally, the press-connecting portion constituted by the U-shaped slot 71 is easily affected by an external force such as a pulling force applied to the wire. Therefore generally, the insulation barrel 78 disposed rearwardly of the press-connecting blade 72 is clamped to the outer periphery of the wire 73 so that the terminal can withstand an external pulling force.

When a wire harness, using this kind of press-connecting terminals, is to be formed, or is to be installed on a vehicle, a large external pulling force is applied to the wire. Therefore, there has been proposed a press-connecting terminal 80 shown in FIG. 8, in which two insulation barrels 78 are provided. A convex portion 79 is provided between the two barrels so as to suitably bend a wire, thereby offering a greater resistance to the pulling.

In the conventional press-connecting terminals, when it is intended to enhance the ability of retaining the wire, it is necessary to provide the two insulation barrels and to increase the height of the convex portion between the barrels, which means that the wire connection portion must be increased in size. However, this convex portion is formed by folding the metal sheet from which the press-connecting terminal is formed, and therefore for increasing the height of projection of the convex portion. The metal sheet for forming the terminal must be correspondingly increased in size. The shaping of the sheet, including the folding operation, becomes cumbersome.

This kind of press-connecting terminal has been required to be simplified in overall construction so as to reduce the amount of the material to be used and also to facilitate the shaping operation. This requirement is contrary to the function of enhancing the ability of retaining the wire, and has not as yet been met.

SUMMARY OF THE INVENTION

With the above problem of the prior art in view, it is an object of this invention to provide a press-connecting terminal which enhances the ability of retaining a wire, and which can reduce the material cost for a metal sheet can be reduced.

Another object of the invention is to provide a connector using such a press-connecting terminal.

This and other objects have been achieved by a press-connecting terminal comprising a wire connection portion at one end portion thereof, and an electrical connection portion at the other end portion thereof for connection to a mating terminal. The wire connection portion includes a press-connecting blade defining a slot into which a covered wire is adapted to be press-fitted and an insulation barrel for fixing the covered wire in the slot. The terminal is formed from an electrically-conductive metal sheet, wherein an opening for receiving part of the covered wire is formed in that region of a bottom plate portion of the wire connection portion where the covered wire is pressed by the insulation barrel.

The other object has been achieved by a connector comprising a connector housing to which the above press-connecting terminal is attached. A bottom portion of the housing has a recess for receiving that portion of the covered wire exposed from the opening. The connector housing has at a rear portion thereof a holder portion for preventing the covered wire from being lifted off the housing bottom portion.

In the above press-connecting terminal of the present invention, the covered wire is effectively bent because of the provision of the opening, so that the wire can be suitably engaged by the terminal. Therefore, in contrast to the prior art, it is not necessary to arrange insulation barrels in the longitudinal direction of the terminal, and the length of the terminal can be shortened. Furthermore, since the convex portion of the wire receiving portion which is raised from the bottom is not always necessary, not only can the material used be reduced, but also the configuration can be simplified. Furthermore, that portion of the wire urged by the insulation barrel is forced into the opening. Therefore the wire is effectively bent because of the provision of the opening, and besides the wire is retained more positively than before by the engagement of the wire with the edge of the opening.

The recess is formed in the housing to which the above press-connecting terminal is attached, the recess being disposed in relation to the opening in the press-connecting terminal. With this arrangement, the recess receives that portion of the covered wire exposed from the opening. By providing the convex portion on the housing adjacent to the recess and by providing the holder portion, the wire can be positively retained without increasing the size of the wire connection portion of the press-connecting terminal.

DESCRIPTION OF THE PREFERRED EMBODIMENTS

One preferred embodiment of the present invention will now be described with reference to FIGS. 1 to 4.

Figure 1:
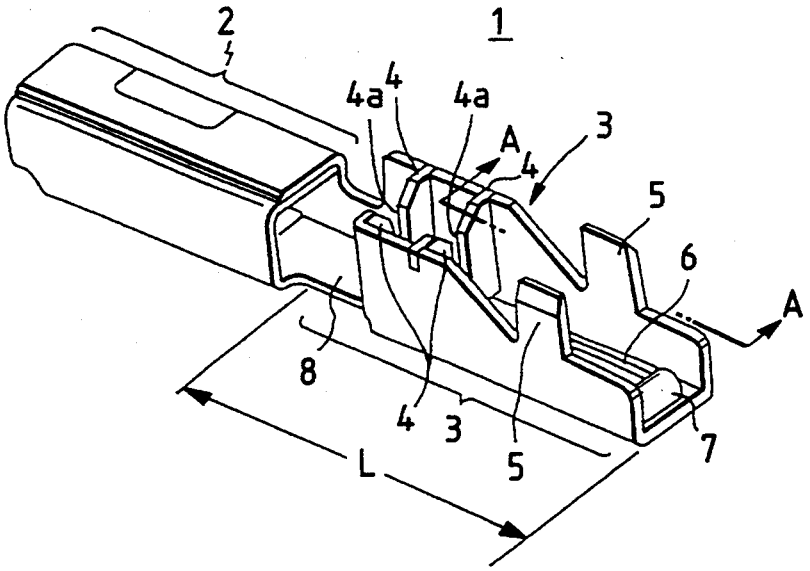
FIG. 1 is a perspective view of a preferred embodiment of a press-connecting terminal of the present invention.
Figure 2:
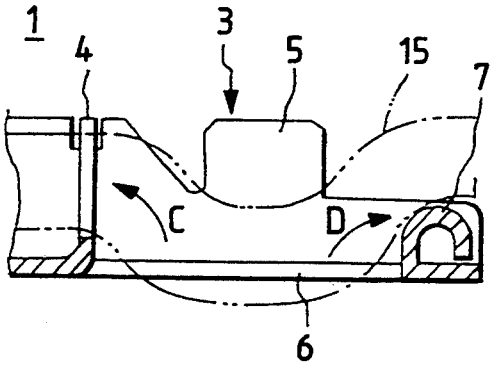
FIG. 2 is a cross-sectional view taken along the line A—A of FIG. 1.
Figure 3:
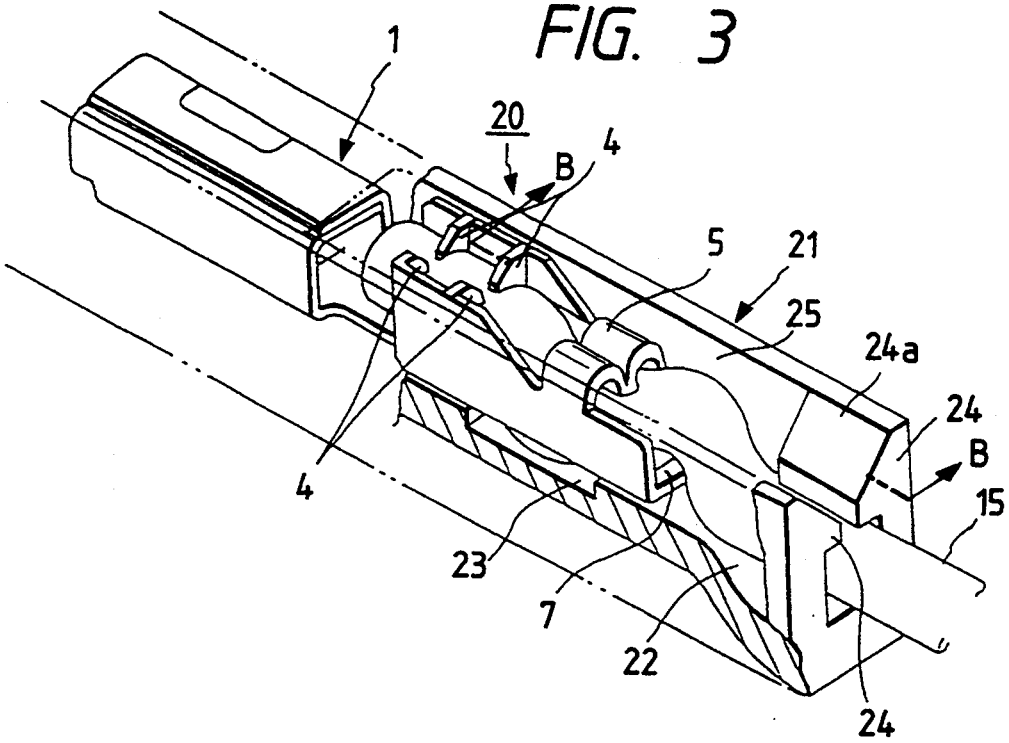
FIG. 3 is a perspective view of a preferred embodiment of a connector of the present invention.
Figure 4:
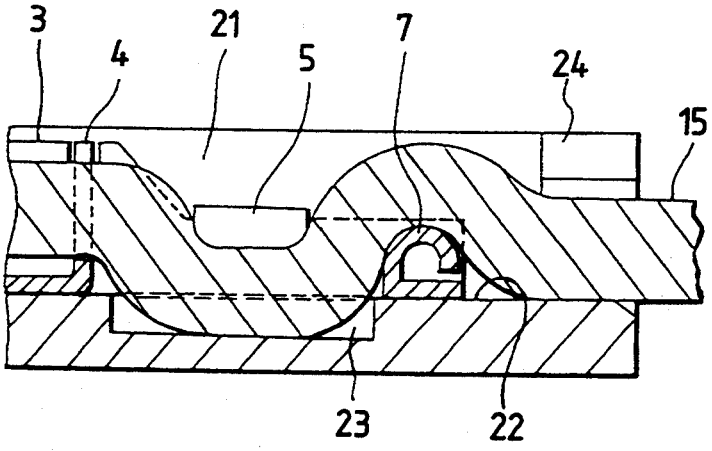
FIG. 4 is a cross-sectional view taken along the line B—B of FIG. 3.

FIG. 1 is a perspective view of a preferred embodiment of a press-connecting terminal of the present invention. FIG. 2 is a cross-sectional view taken along the line A—A of FIG. 1. FIG. 3 is a perspective view of a preferred embodiment of a connector of the present invention using the press-connecting terminal of FIG. 1, and FIG. 4 is a cross-sectional view taken along the line B—B of FIG. 3.

As shown in FIGS. 1 and 2, the press-connecting terminal of this embodiment is formed from an electrically-conductive metal sheet by stamping and shaping as is the case with the conventional terminal, and includes an electrical connection portion 2 for connection to a mating terminal, and a wire connection portion 3 for retaining and connecting a covered wire 15. The wire connection portion 3 includes two press-connecting blades 4 each defining a slot 4*a* into which the covered wire 15 is adapted to be press-fitted, and an insulation barrel 5 for fixing the covered wire 15 in the slots. In this embodiment, an opening 6 is formed through a bottom plate portion 8 of the wire connection portion 3, and is disposed between the press-connecting blade 4 and a convex portion 7. This opening 6 is provided at that region where the covered wire 15 is to be urged or pressed by the insulation barrel 5. This opening receives part of the covered wire. When the covered wire 15 is urged toward the bottom plate portion 8 by the insulation barrel 5, the covered wire is forced into the opening 6.

During the shaping of the press-connecting terminal 1 after the stamping operation, the rear press-connecting blade 4 is formed by bending part of the bottom plate portion 8 upright, and the convex portion 7 is formed by curling part of the bottom plate portion 8 upwardly. Therefore, the opening 6 is substantially formed as a result of the formation of the press-connecting blade 4 and the convex portion 7.

When the wire 15 is connected to the press-connecting terminal 1, that portion of the wire pressed by the insulation barrel 5 (not bent in FIG. 2) is displaced downward to be forced into the opening 6 as shown in phantom in FIG. 2. Also the barrel suitably contacts the wire because of the holding of the wire between the barrel and the convex portion 7 and also of the bending operation. As a result, curved portions of the wire 15 are formed by the opening 6, and are disposed respectively on the front and rear sides of the barrel. Also, the wire 15 is engaged with the edge of the opening 6 (The manner of engagement of the wire with the edge varies depending on the shape of the opening), and this enhances the ability of retaining the wire 15.

In contrast with the prior art, the press-connecting terminal of this embodiment does not need a plurality of insulation barrels arranged in the direction of the length of the terminal. Therefore the length L of the wire connection portion 3 can be reduced, and also the configuration can be simplified.

A connector 20 to which the press-connecting terminal 1 of the above construction is to be attached includes a connector housing 21 whose upper portion is open at 25 as shown in FIGS. 3 and 4. The press-connecting terminal 1 is attached to the connector through this opening 25. A recess 23, for example, of a rectangular shape is formed in a bottom portion 22 of the housing, and receives that portion of the covered wire 15 exposed from the opening 6. A pair of holder portions 24 are provided rearwardly of the recess 23, and project respectively from the opposite sides of the connector housing. The upper surfaces of these holder portions 24 cooperate with each other to provide a tapering surface 24*a*.

For assembling the connector 20, for example, the press-connecting terminal 1, to which the covered wire 15 has not yet been connected, is mounted in position in the connector housing 21. Then, the end portion of the covered wire 15 is brought into contact with the wire connection portion 3 of the press-connecting terminal, and is placed at the housing opening 25. Then, the covered wire 15 is forced into the wire connection portion 3 by a clamping tool (not shown), and the insulation barrel 5 is bent. At this time, the covered wire 15 is also urged into a position below the holder portions 24. As a result, the connector is assembled with the covered wire 15 connected to the terminal, as illustrated.

That portion of the covered wire 15 exposed from the opening 6 is received in the recess 23, and also the covered wire is lifted away from the bottom by the convex portion 7 disposed rearwardly of the recess 23. Further the covered wire 15 is prevented by the holder portions 24, disposed rearwardly of the convex portion 7, from being lifted off the housing bottom portion 22, so that the bending of the wire is effectively achieved, and the wire is positively fixed.

In this embodiment, although the connector housing 21 is of such a type that one press-connecting terminal 1 is attached thereto, the connector is not limited to such a construction, and the connector may be of the multi-terminal type in which a plurality of press-connecting terminals 1 are juxtaposed.

The present invention is not limited to the above description, and the configuration of the electrical connection portion 2, the press-connecting blade 4 and the insulation barrel 5, as well as the size and shape of the opening 6, can be modified in various ways. For example, the press-connecting terminal and the connector can be modified as shown in FIGS. 5 and 6.

Figure 5:
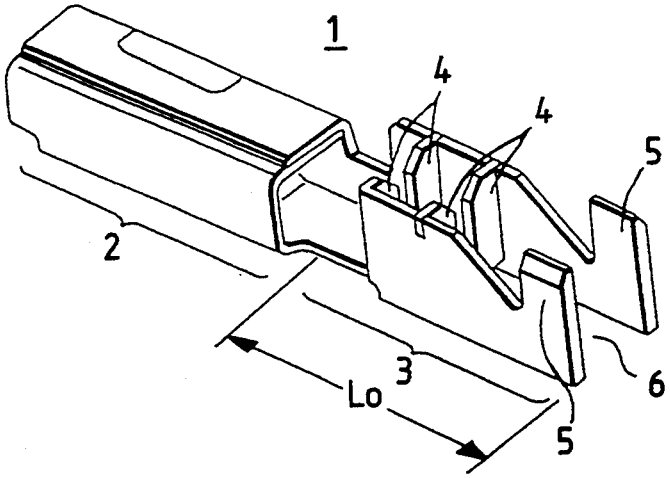
FIG. 5 is a perspective view of a modified press-connecting terminal of the invention.
Figure 6:
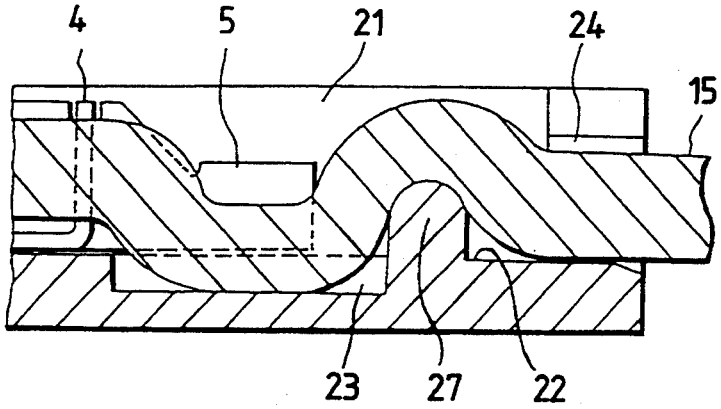
FIG. 6 is a cross-sectional view of an important portion of a modified connector of the invention.
Figure 7:
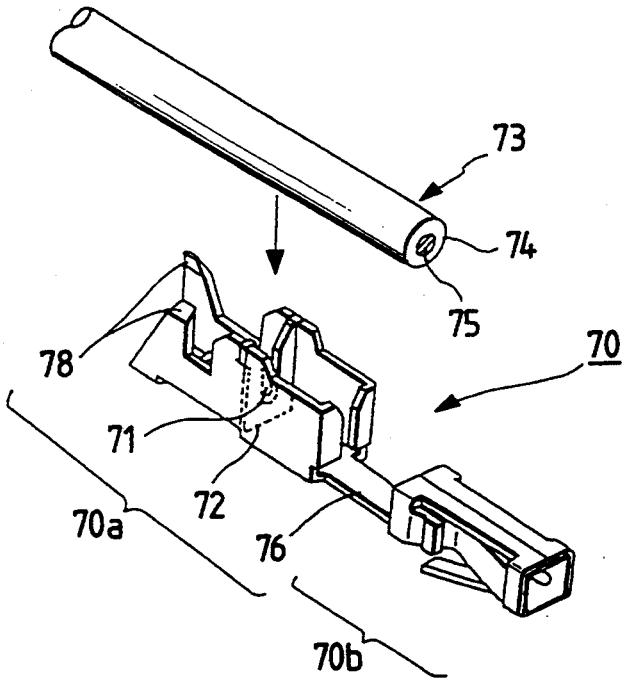
FIG. 7 is a perspective view of a conventional press-connecting terminal.
Figure 8:
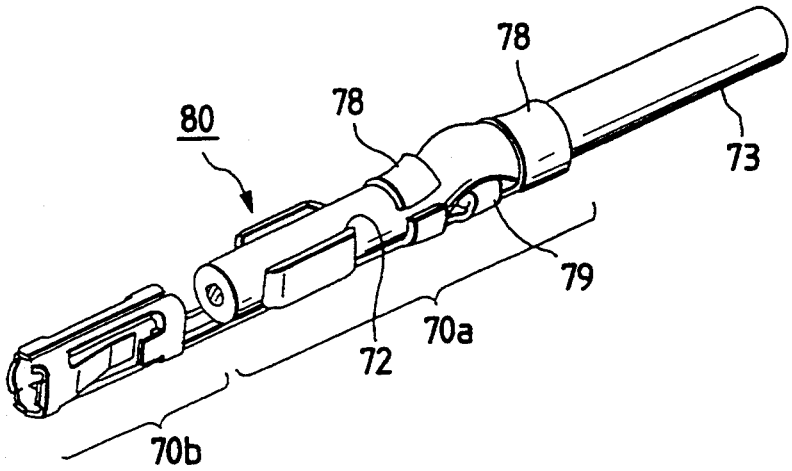
FIG. 8 is a perspective view of another conventional press-connecting terminal.

A press-connecting terminal 1 shown in FIG. 5 differs from the terminal of FIG. 1 in that the convex portion 7 is omitted. More specifically, an insulation barrel 5 is provided at a rear end of the terminal, and an opening 6 is a notch-like one. Therefore, the length $L_o$ of the terminal can be smaller than that of the terminal of FIG. 1. On the other hand, a connector housing 21 to be mated with this press-connecting terminal 1 has a convex portion 27 formed on a housing bottom portion 22 adjacent to a rear end of a recess 23, the convex portion 27 replacing the convex portion 7 of the above embodiment.

With this construction, a wire connection portion 3 of the press-connecting terminal 1 can be reduced in size, and the wire can be retained positively, as in the above embodiment.

As described above, in the press-connecting terminal of the present invention, the opening for receiving part of the covered wire is formed in that region of the bottom plate portion of the wire connection portion where the covered wire is pressed by the insulation barrel. With this arrangement, the covered wire can be bent effectively to enhance the retaining ability. Therefore, even if a plurality of insulation barrels are not arranged in the direction of the length of the terminal in contrast to the prior art, the retaining ability can be maintained, and the length of the terminal can be shortened, and also its configuration can be simplified to reduce the amount of the material to be used.

In the connector of the present invention, the recess is formed in the housing in relation to the opening in the press-connecting terminal, and with this arrangement that portion of the covered wire exposed from the opening is received by this recess. Therefore, the press-connecting terminal having the opening can be attached to this connector. If the convex portion is formed on the housing adjacent to the recess, the convex portion on the press-connecting terminal can be omitted. Further, by providing the holder portions rearwardly of the convex portion, the wire is retained positively, and the connector can be used in such a manner as to fully enjoy the advantage that the wire connection portion of the press-connecting terminal is reduced in size.

What is claimed is:

1. A press-connecting terminal, comprising:

a wire connection portion disposed at one end of said terminal, said wire connection portion including a press-connecting blade defining a slot into which a covered wire is adapted to be press-fitted, a bottom plate portion, and an insulation barrel for fixing the covered wire in said slot;

an electrical connection portion disposed at the other end of said terminal for allowing connection to a mating terminal; and an opening, for receiving a part of the covered wire, formed in said bottom plate portion of said wire connection portion opposite said insulation barrel, wherein said terminal is formed from an electrically-conductive metal sheet.

2. The terminal according to claim 1, wherein said opening has a circumferential edge portion which is partially opened.

3. The terminal according to claim 1, wherein said opening has a circumferential edge portion which is closed.

4. A connector system, comprising:

a press-connecting terminal, having a wire connection portion disposed at one end of said terminal, said wire connection portion including a press-connecting blade defining a slot into which a covered wire is adapted to be press-fitted, a bottom plate portion, and an insulation barrel for fixing the covered wire in said slot; an electrical connection portion disposed at the other end of said terminal for allowing connection to a mating terminal; and an opening, for receiving part of the covered wire, formed in said bottom plate portion of said wire connection portion opposite said insulation barrel, said terminal being formed from an electrically-conductive metal sheet; and a connector housing to which said press-connecting terminal is coupled, said housing having a bottom portion having a recess for receiving said part of the covered wire exposed through said opening, said connector housing having a holder portion, disposed at a rear portion of said connector housing, for preventing the covered wire from being lifted off said housing bottom portion.

5. The terminal according to claim 3, further comprising a convex portion, disposed longitudinally adjacent said opening for raising said covered wire.

6. The terminal according to claim 5, wherein said opening is formed from binding said bottom plate portion of said wire connection portion, thereby forming said convex portion and said press-connecting blade.

7. The connector system according to claim 4, wherein said housing further includes a convex portion, disposed longitudinally adjacent said opening for raising said covered wire.

8. The connector system according to claim 7, wherein said opening is formed from binding said bottom plate portion of said wire connection portion, thereby forming said convex portion and said press-connecting blade.

* * * * *